US006846294B2

(12) United States Patent
Rastegar et al.

(10) Patent No.: US 6,846,294 B2
(45) Date of Patent: Jan. 25, 2005

(54) EXTERNAL COUNTERPULSATION CARDIAC ASSIST DEVICE

(75) Inventors: Jahangir Rastegar, Stony Brook, NY (US); Harry S. Soroff, Northport, NY (US)

(73) Assignee: PPT LLC, Sands Point, NY (US)

( * ) Notice: Subject to any disclaimer, the term of this patent is extended or adjusted under 35 U.S.C. 154(b) by 90 days.

(21) Appl. No.: 09/851,930

(22) Filed: May 10, 2001

(65) Prior Publication Data

US 2002/0169399 A1 Nov. 14, 2002

(51) Int. Cl.[7] ..... A61H 9/00; A61H 23/00

(52) U.S. Cl. ..... 601/9; 601/11; 601/44; 601/152

(58) Field of Search ..... 601/43, 44, 41, 601/6, 9–11, 148, 151, 152, 149, 150; 128/DIG. 20; 602/13

(56) References Cited

U.S. PATENT DOCUMENTS

| | | | | | |
|---|---|---|---|---|---|
| 2,223,570 | A | * | 12/1940 | McMillin | 601/44 |
| 2,241,444 | A | * | 5/1941 | Bower | 601/44 |
| RE24,357 | E | * | 9/1957 | Emerson | 601/44 |
| 3,043,292 | A | * | 7/1962 | Mendelson | 601/44 |
| 3,368,550 | A | * | 2/1968 | Glascock | 601/44 |
| 4,003,378 | A | * | 1/1977 | Pickering | 128/205.17 |
| 4,257,407 | A | * | 3/1981 | Macchi | 601/44 |
| 4,481,938 | A | * | 11/1984 | Lindley | 601/43 |
| 4,621,621 | A | * | 11/1986 | Marsalis | 601/44 |
| 4,770,165 | A | | 9/1988 | Hayek | |
| 4,824,105 | A | * | 4/1989 | Goldenberg | 482/113 |
| 5,222,478 | A | * | 6/1993 | Scarberry et al. | 601/44 |
| 5,554,103 | A | | 9/1996 | Zheng et al. | |
| 5,562,604 | A | | 10/1996 | Yablon et al. | |
| 5,900,299 | A | * | 5/1999 | Wynne | 428/69 |
| 5,997,540 | A | | 12/1999 | Zheng et al. | |

OTHER PUBLICATIONS

Article on External Counterpulsation, Management of Cardiogenic Shock After Myocardial Infarction, pp. 1193–1202 and Table 1, p. 1442.

* cited by examiner

*Primary Examiner*—Danton DeMille
(74) *Attorney, Agent, or Firm*—Frommer Lawrence & Haug LLP; Dennis M. Smid

(57) ABSTRACT

The cardiac assist device includes a sealed tubular housing for externally applying positive and negative relative pressure to a limb in counterpulsation with heart function. The applicator is assembled, in situ, to provide customized fit. It includes a fabric or sponge-like inner layer cut to size and situated around the limb. Initially deformable material is sized, sealed around the inner fabric layer and then secured by straps or the like to form a relatively rigid, non-expandable tubular shell. The shell may include an interior wall composed of a sheet of hard plastic or articulated sections of hard plastic or metal. The interior wall has a plurality of openings to the sealed shell interior. The exterior shell wall is positioned around the interior wall. The shell walls are spaced apart by radially and/or longitudinally extending spacer elements defining a multi-section air flow chamber between the walls. The interior shell wall and spacer elements may be integral. The spacer elements include passages such that air pumped into and out of the shell chamber is uniformly distributed and moves freely to and from the shell interior. A heater may be used to regulate the air temperature to promote vascular dilation.

17 Claims, 8 Drawing Sheets

FIG. 9
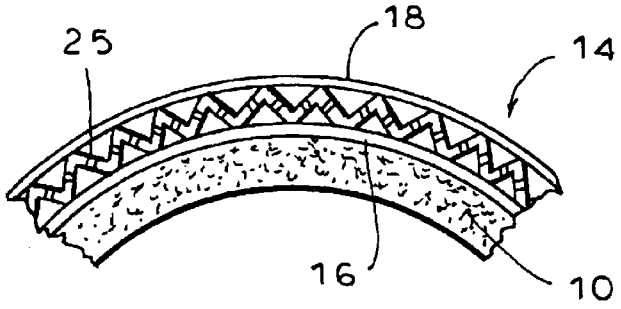
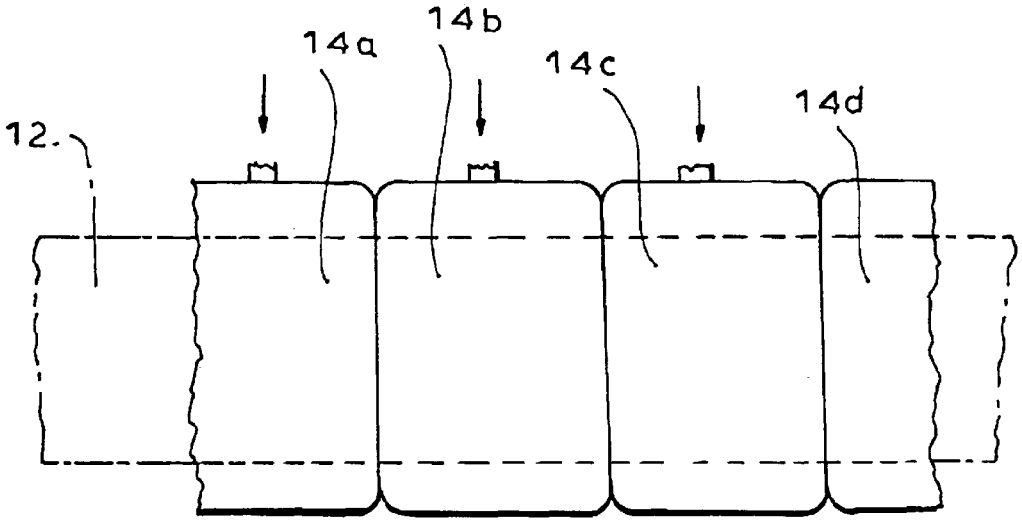
FIG. 10

EXTERNAL COUNTERPULSATION CARDIAC ASSIST DEVICE

The present invention relates to an external counterpulsation cardiac assist device which functions by applying positive and negative relative pressure to the limbs and more particularly, to a relatively rigid, sealed housing for applying positive and negative relative (to atmospheric) pressure to the limbs in counterpulsation with heart function, which is adapted to be assembled in situ to provide customized fit and which requires reduced pumping capacity.

A method of assisting the circulation without invading the vascular system by the external application of intermittent pressure to the body has been known. Studies have shown that application of a positive relative pressure pulse to the lower extremities during cardiac diastole can raise the diastolic pressure by 40% to 50% while the application of negative relative pressure (vacuum), during cardiac systole can lower the systolic pressure by about 30%. Hereinafter, by "relative" pressure, it is meant relative to the atmospheric (gauge) pressure.

This externally applied positive and negative relative pressure increases the venous return to the heart because of the unidirectional valves in the peripheral venous bed. In cariogenic shock accompanied by myocardial ischemia, the increased coronary flow may improve cardiac function and thus indirectly affect the hemodynamic response to this procedure. Further, it is believed to promote the growth of collateral channel blood vessels feeding heart tissue and to reduce the symptoms of angina.

The therapeutic results of this method are well documented. However, as a practical matter, the apparatus used to externally apply positive and negative relative pressure to the limbs has been extremely inefficient and therefore the procedure has not found wide acceptance.

Early apparatus employed for this purpose included a prefabricated hinged conical metal housing or shell housing. Within the housing, a hollow cylindrical inflatable rubber balloon-like tube was placed, within which the limb segment was situated. The balloon-like rubber tube was filled with water, which was pressurized to inflate the tube, thereby filling the interior of the housing and applying pressure to the surface area of the limb segment.

To apply negative relative pressure, the water was first pumped out of the rubber tube, leaving an air gap between the rubber tube and the limb. An impermeable, rubber-like coated fabric was placed around the exterior of the housing, and was sealed around the limb to trap the air between the limb and the rubber tube. By pumping out the air trapped within the sealed fabric, the fabric first collapsed around the housing, and then negative pressure began to form within the gap between the limb and the rubber tube.

This system had numerous operational difficulties. Due to high resistance to flow, it was nearly impossible to pressurize the rubber tube and pump the water out of the rubber tube fast enough to match the heart beat. As the result, even the process of applying positive relative pressure was very difficult. The process was made even more difficult since a prefabricated housing could not be made to closely fit every patient, therefore a relatively large gap was left between the rubber tube and the limb to be filled by the expanding rubber tube. The amount of air that had to be pumped out of the rubber-coated fabric enclosed space around the housing and in between the limb and the rubber tube was relatively large, thereby requiring large air pumping action. In addition, due to the flexibility of the rubber-coated fabric, it would tend to deform and enter the space between the limb and the rubber tube, thereby making it difficult to achieve the desired level of negative pressure (vacuum) around the limb.

Current applicators utilize a prefabricated and relatively non-extensible fabric within which a balloon-like element is located. The balloon-like element with its enclosing housing or cuff is wrapped around the limb and secured by straps equipped with hook and loop tape, commercially known as VELCRO. Such applicators are currently available from Vassmedical, Inc. of Westbury, N.Y.

During its operation, the balloon is pressurized by air, thereby applying pressure to the surface of the enclosed limb. Due to the bulging and deformation of the cuff as the balloon is pressurized, a relatively large volume of air is required to achieve the required limb surface pressure. This is the case even though the cuff material is relatively non-extensible and the cuff is applied snugly to the limb segment. As the result, large capacity pumps are required to drive the apparatus because of the large volume of air which has to be rapidly moved in and in most cases out of the balloons, to alternatively inflate and deflate the balloons, to apply the required pressure to the limb. This and all variations of such applicator designs that use balloons to apply pressure, cannot be used to apply relative negative pressure to the limb. Another disadvantage of the current applicators is that due to the requirement of a large air volume, the system is rendered non-portable, and hence cannot be made available outside a fixed treatment room and cannot be available in emergency situations.

An attempt has recently been made to develop design concepts with a rigid or semi-rigid outer shell which surround an inflatable balloon-type interior. An applicator of this type is illustrated in U.S. Pat. No. 5,554,103 issued Sep. 10, 1996 to Zhang, et al. and U.S. Pat. No. 5,997,540 issued Dec. 7, 1999 to Zhang, et al., both of which are owned by Vasomedical, Inc. of Westbury, N.Y. Those applicators are described to be wrapped around the limb and held in place with some means such as straps of VELCRO. However, such prefabricated applicator designs cannot closely fit the limb and thus still require a large volume of air to provide the required limb surface pressure level. This is the case since such prefabricated applicators cannot be made to precisely fit a limb segment, thereby leaving a significant dead space between the balloon-like tube and the limb.

The aforementioned patents propose to fill the dead space by spacers to reduce the amount of air required for the operation of the applicator. These spacers have to be cut in various shapes and thicknesses and therefore are highly cumbersome and impractical.

The outer shells and applicators may be custom made to fit the limb segments. A large number of applicators of various sizes and shapes may also be fabricated to nearly accommodate the contour of the limbs of various patients. Custom made applicators are obviously impractical. The fabrication and hospital inventory of a large number of applicators of different sizes and shapes suitable for a wide variety of different size patients is also impractical.

In addition, since such applicators operate by pressurizing balloon-like tubes around the limb segment, they cannot be used to apply negative relative pressure to the limb segment.

The present invention overcomes these disadvantages through use of a uniquely designed applicator housing with an internal air distribution system. The applicator is custom fit to the limb and therefore requires much less air volume to operate than prior art applications. Since Less air volume is needed to operate the housing, much smaller capacity, much lighter and less expensive air pumps are required. Because the applicator housing is assembled in situ from deformable components which are rigidified as they are secured on the patient, and thus can be customized for each patient, the necessity of inventorying large numbers of prefabricated housing components is eliminated while, at the same time, the preciseness of the fit for each individual patient is greatly enhanced.

The amount of air volume required is reduced because the gap between the shell and the limb surface can be made very small, thereby minimizing the total space which must be pressurized. The main limitation in employing such a small gap between the shell and limb surface is the resistance to the air flow in and out of the shell. However, air flow is readily enhanced by the internal air distribution system of the shell and by employing multiple air inlets to the shell.

Further, by minimizing the volume of air required, substantially the same air can be rapidly pumped in and out of the housing to generate positive and negative relative pressures in a relatively closed system. This provides an efficient means to control the air pressure, and also permits the air temperature to be closely controlled. Controlling the temperature of the air is important because warmer air promotes vascular dilation, resulting in greater blood flow and hence more efficient operation of the apparatus.

In addition, due to the use of a relatively rigid shell with an internal air distribution system, the inflatable balloon-like interior of the prior art systems is eliminated. This permits the applicator of the present invention to apply both negative as well as positive relative pressure to the limb. The Vasomedical applicators, for example, cannot apply negative relative pressure.

It is, therefore, a prime object of the present invention to provide an external counterpulsation cardiac assist device with applicators capable of applying both positive and negative relative pressure to the limb.

It is another object of the present invention to provide a counterpulsation cardiac assist device with an applicator that requires a relatively small air volume to operate, and hence reduced pump capacity.

It is another object of the present invention to provide an external counterpulsation cardiac assist device which eliminates the use of an inflatable balloon-like tube.

It is another object of the present invention to provide an external counterpulsation cardiac assist device which includes a positive and negative relative pressure applicator which can be assembled in situ, and thus customized to precisely fit the limb of each patient.

It is another objective of the present invention to provide an external counterpulsation cardiac assist device that is significantly lighter than the existing systems, thereby making it portable such that it can be moved to the patient, rather than requiring the patient to go to a specially equipped facility for treatment.

It is another object of the present invention to provide an external counterpulsation cardiac assist device that is preferably used in which the air temperature can be readily controlled to promote vascular dilation.

It is another object of the present invention to provide an external counterpulsation cardiac assist device having an applicator with a relatively rigid shell that can be readily secured to the limb segment while sealing the applicator inner chamber around the limb segment.

It is another object of the present invention to provide an external counterpulsation cardiac assist device that is preferably used with an air permeable, inner layer covers the limb segment over which a relatively rigid shell is secured and sealed.

It is another object of the present invention to provide external counterpulsation cardiac assist device including a positive and negative relative pressure applicator with a rigid or semi-rigid shell having an internal air distribution system within the sealed exterior shell, which is spaced apart from the limb surface by radial and/or longitudinal elements defining a tubular chamber adapted to be connected to a pumping system functioning to move air into and out of the chamber, in synchronization with the operation of the heart.

The applicator of the present invention provides positive relative pressure application and negative relative pressure (vacuum) application to the limb by pressurizing and developing a vacuum within the sealed interior of the housing. The shell which defines the interior of the housing is sufficiently rigid and non-expandable, once secured around the limb, so as to contain the positive pressure and sufficiently non-collapsible to permit a significant vacuum to be developed.

In one embodiment of the present invention, the interior shell wall is spaced from the exterior shell wall by radial and/or longitudinal elements so as to define a tubular chamber. The chamber is adapted to be connected to a pump that moves air into and out of the chamber, in synchronization with the operation of the heart.

The shell is preferably initially deformable so that it can be fashioned to closely conform to the shape and size of the limb. Once in place, the interior of the shell is sealed. The shell becomes relatively rigid once it is secured.

An inner layer is preferably situated within the shell interior, adjacent to the limb. This layer is preferably made of highly air permeable material, such as fabric, felt or sponge-like materials, which are flexible in bending but relatively resistant to pressure, i.e., not readily compressed under pressure.

The shell components are preferably initially separate from the permeable inner layer. The tubular space between the walls of the shell defines an internal air distribution system which allows free flow of air between the pump and the permeable inner layer within the shell interior. The permeable inner layer is designed to provide minimal resistance to the air flow.

The positive and negative relative pressure cycle and its time profile is preferably controlled by a microprocessor based computer system which receives input from an electrocardiogram or other heart function monitoring device. The positive relative pressure may be provided by an air compressor, a pressurized air tank and/or an air pump. Negative relative pressure can be provided by a vacuum pump. However, a spring-loaded pump mechanism which provides both positive and negative relative pressure, as described below, is preferred.

In accordance with one aspect of the present invention, an external counterpulsation cardiac assist device is described for providing positive and negative relative pressure to a segment of the body in synchronization with the operation of the heart. The device includes a housing. The housing includes a relatively rigid tubular shell surrounding the body segment and an air permeable flexible inner layer situated within the shell interior, proximate the body segment. Means are provided for sealing the shell interior. The shell has an internal air distribution system which operably connects the air supply and the shell interior.

The shell is preferably formed by spaced interior and exterior walls. Spacing means are interposed between the shell walls, defining an air chamber therebetween. The interior shell wall has a plurality of openings facilitating free flow of air between the chamber and the shell interior.

One or more ports in the exterior shell wall are provided. These ports operably connect the chamber and an air supply.

The spacer means separates the internal air chamber of the shell into sections. Air passages are provided through the spacer means to connect the chamber sections. The spacer means can have radially or longitudinally extending spacer walls. Other shapes, such as honeycomb or the like, are useable as well, depending upon the configuration.

The interior shell wall and the spacer means are preferably joined to form an assembly. The exterior shell wall is situated over the assembly. Means are provided for securing the exterior shell wall over the assembly to rigidify the shell.

The interior shell wall is preferably composed of relatively rigid material such as a sheet of plastic or hard rubber, or of a plurality of articulately connected sections of plastic or the like or metal sections.

The inner layer is preferably comprised of fabric, felt or sponge like material. The layer is hard enough to resist the pressure of the interior shell wall during the assembly of the applicator, but is flexible enough not to provide significant resistance to the expanding limb during the application of the negative relative pressure. The material is also flexible enough for significant bending so as to be readily formed to the shape of the limb during the assembly.

The exterior shell wall is air impermeable and preferably composed of flexible but non-extensible sheet material, such as various types of sealed fabrics or plastic.

The interior shell wall and spacer means are preferably integral. Alternatively, both the shell walls and the spacer means may be integral.

The means for sealing the shell over the inner layer preferably comprises sealing tape. The means for securing the exterior shell wall preferably comprises straps or bands which are relatively non-extensible.

The exterior wall may be kept in position relative to the top of the spacers by sections of hook and loop tape or simply by friction enhancing roughened surfaces. In such cases, the top surfaces of the spacer walls may be enlarged to enhance the securing action.

In another preferred embodiment of the present invention, the shell consists only of an exterior wall. No interior wall is used. An air permeable flexible inner layer is placed over the body segment. Spacer means separate the air permeable inner layer from the exterior shell wall, forming an interior air chamber. The spacer means separates the internal air chamber of the shell into sections. Air passages are provided through the spacer means to connect the chamber sections. The spacer means can have radially or longitudinally extending spacer walls. Other shapes, such as honeycomb or the like, are usable as well.

As in the previous embodiment of the present invention, means are provided for sealing the shell interior. The internal air distribution system of the shell operably connects the air supply and the shell interior. One or more ports in the exterior shell wall are provided to operably connect the shell interior chamber and the air supply.

The spacer means and the exterior shell wall may be integral. Alternately, the spacer means and exterior shell wall may be separate, in which case the spacer means is cut and assembled around the air permeable flexible inner layer. The exterior wall is then situated over the assembly. Means are provided for securing the exterior shell wall over the assembly to rigidify the shell.

The inner layer described in the previous embodiment may or may not be utilized in this preferred embodiment. If it is not used, the spacer means are situated proximate the body segment.

Throughout this specification, the present invention is described for purposes of illustration as being air driven. While air is the preferred fluid for many reasons, including low viscosity, non-toxicity, non-flammability, availability, etc., it should be understood that other gases or liquids could be used.

To these and to such other objects which may hereinafter appear, the present invention relates to an external counter-pulsation cardiac assist device as described in detail in the following specification, recited in the annexed claims and illustrated in the accompanying drawings, wherein like numerals refer to like parts and in which:

FIG. 9 is a cross-sectional view showing a typical section of the shell of a fourth preferred embodiment of the present invention;

FIG. 10 is a side elevation view of a fifth preferred embodiment of the present invention;

Figure 1:
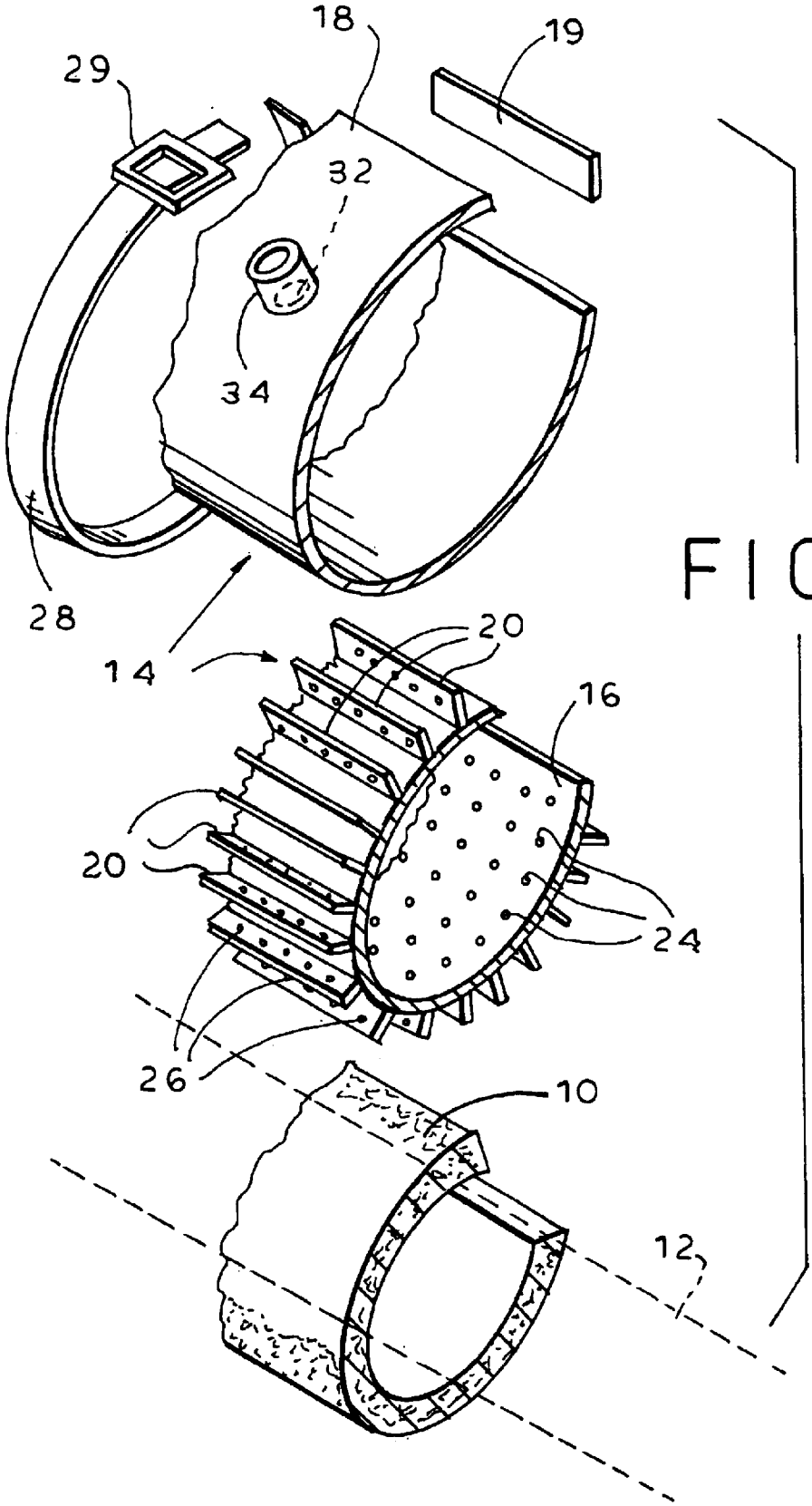
FIG. 1 is an exploded isomeric view of a typical section of a first preferred embodiment of the device housing.
Figure 2:
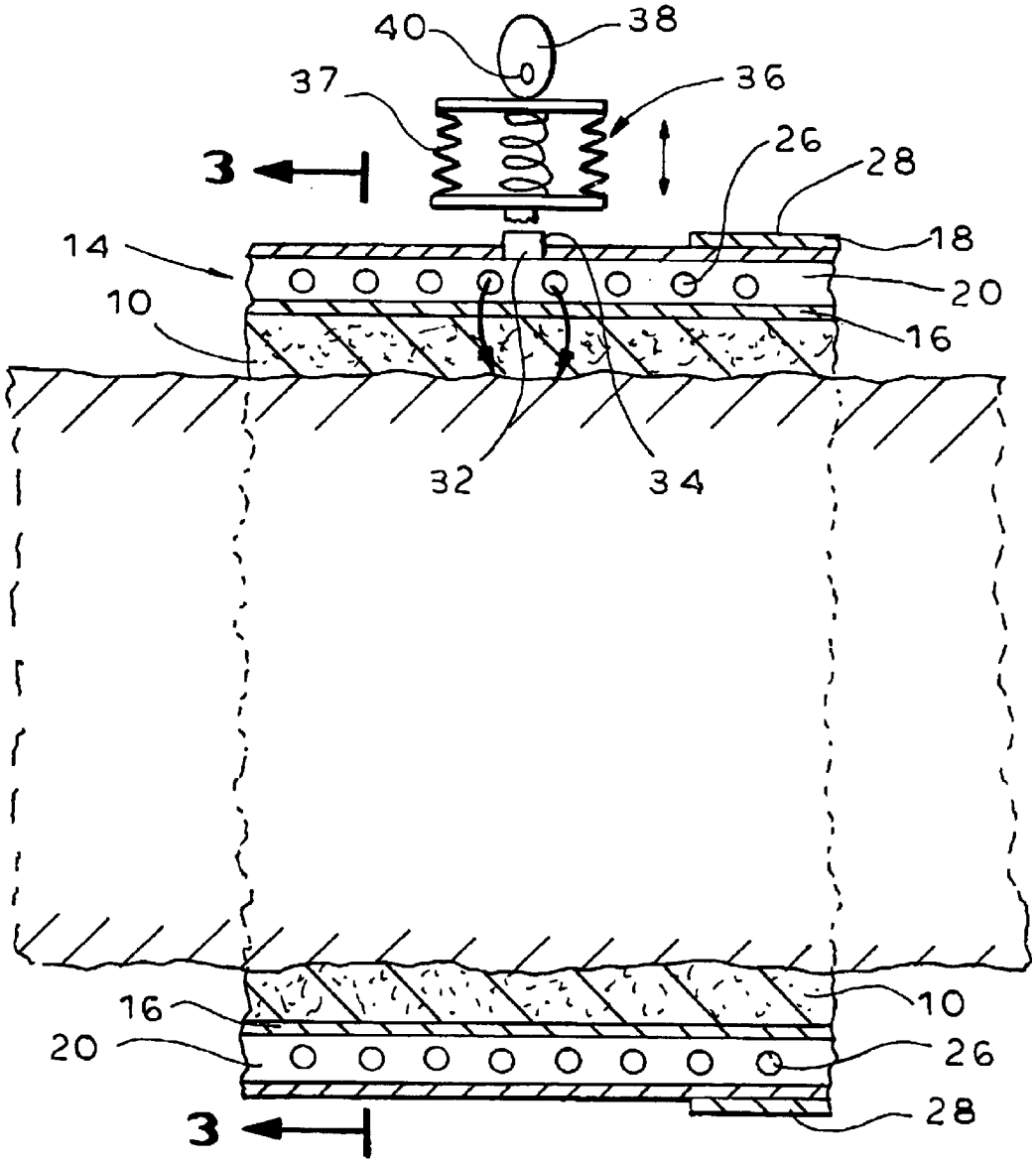
FIG. 2 is a cross-sectional view of the housing of FIG. 1, as it would appear mounted on the limb of a patient.
Figure 3:
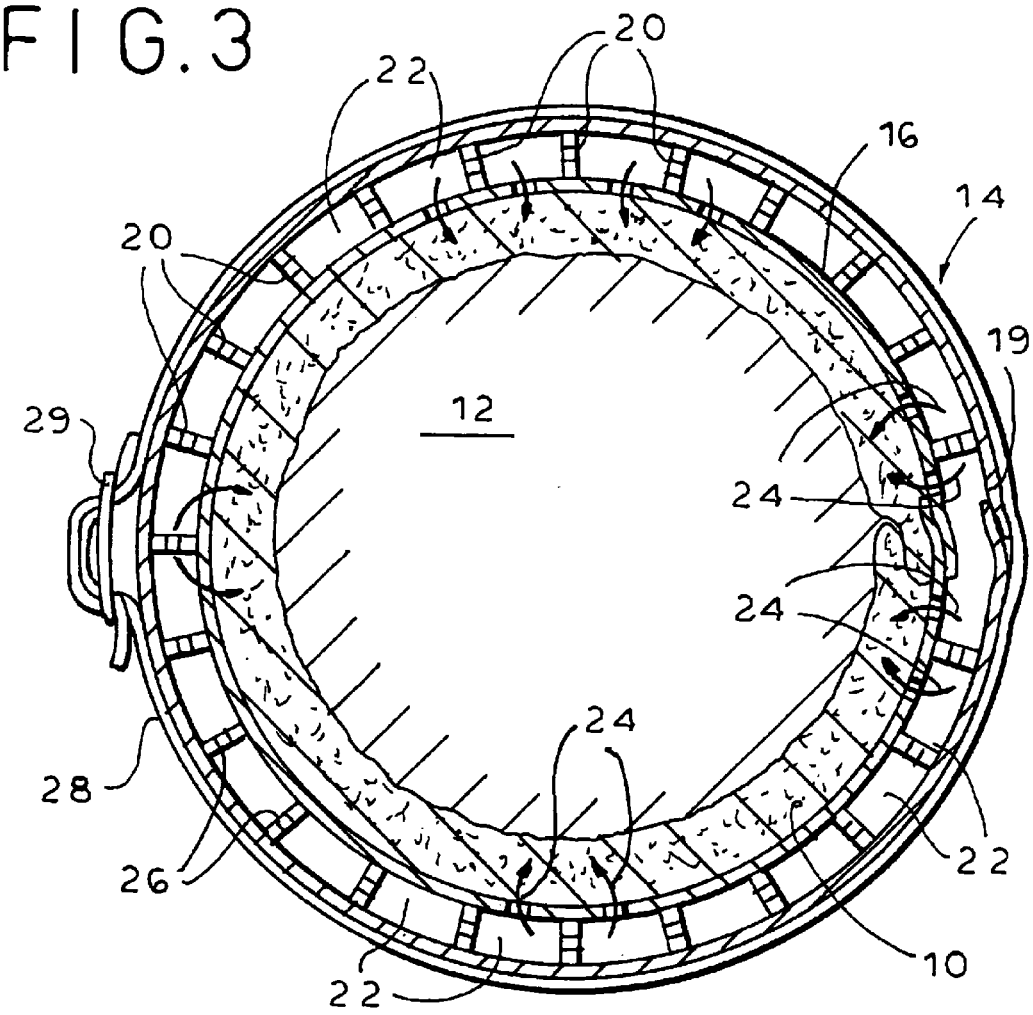
FIG. 3 is an isometric cross-sectional view taken along line 3—3 of FIG. 2.

The first preferred embodiment of the invention, as illustrated in FIGS. 1, 2 and 3, consists of a tube-like housing, a typical precut section of which is illustrated. The housing is adapted to be assembled in situ, and custom fitted to a limb, such as an arm or leg or to entire lower portion of the body, including the thighs and buttocks. The housing consists of a flexible, air permeable inner layer 10 composed of a sheet of fabric, felt or sponge-like material. Inner layer 10 is placed around the limb 12 and trimmed to size using a scissor or blade.

Around inner layer 10 is tightly fitted a hollow shell 14 which is initially deformable enough to closely conform to the contours of the limb. After shell 14 is sealed and secured in place around the limb as described below, it will become relatively rigid.

Shell 14 consists of an interior wall 16 and an exterior wall 18. Walls 16 and 18 are spaced apart by a plurality of upstanding spacer elements 20, so as to form an internal air distribution system defined by air flow chamber 22 between the shell walls.

Figure 4:
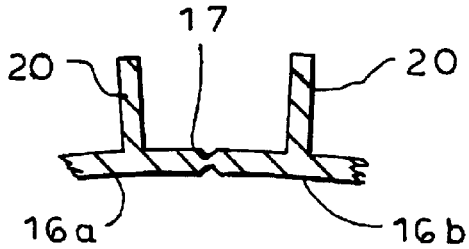
FIG. 4 is a cross-sectional view showing a portion of adjacent sections of the interior shell wall which are connected by a "living hinge."
Figure 5:
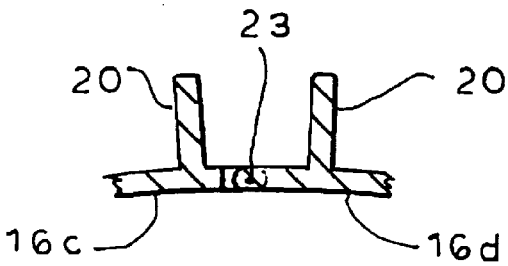
FIG. 5 is a view similar to FIG. 4 but showing a portion of adjacent sections connected by a hinge.

Interior shell wall 16 has a plurality of openings 24 which permit the free flow of air between chamber 22 and the shell interior. Openings 24 are arranged in a pattern which is determined by the configuration of the spacer elements. Wall 16 is relatively rigid particularly in the transverse and longitudinal directions. It can be formed of a single, initially deformable sheet of hard rubber or plastic 16, as shown in FIGS. 1, 2 and 3, or sections 16*a*, 16*b* of hard rubber or plastic connected by "living hinges" 17, as shown in FIG. 4, or sections 16*c*, 16*d* of metal connected by mechanical hinges 23, as shown in FIG. 5. If rubber or plastic, the sections of wall 16 can be provided flat and then deformed as required to fit snugly around inner layer 10.

Figure 7:
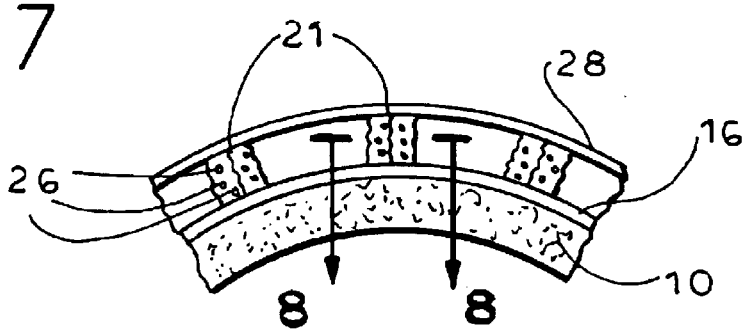
FIG. 7 is a cross-sectional view of a typical section of the shell of a third preferred embodiment of the present invention.
Figure 8:
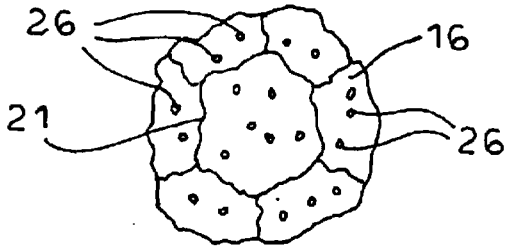
FIG. 8 is a cross-sectional view taken along line 8—8 of FIG. 7.
Figure 11:
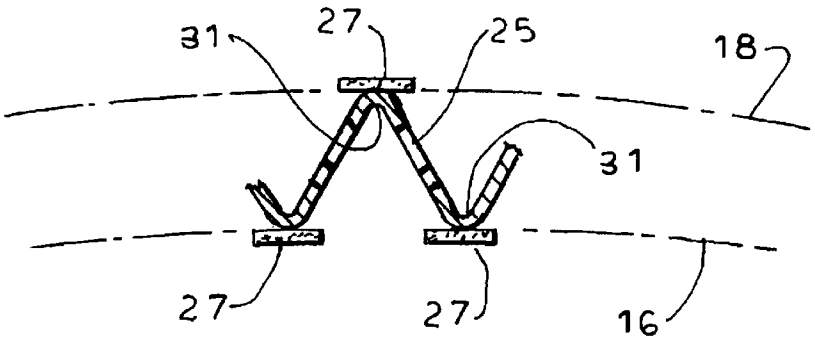
FIG. 11 is a cross-sectional view showing a typical section of the shell of a sixth preferred embodiment of the present invention.
Figure 14:
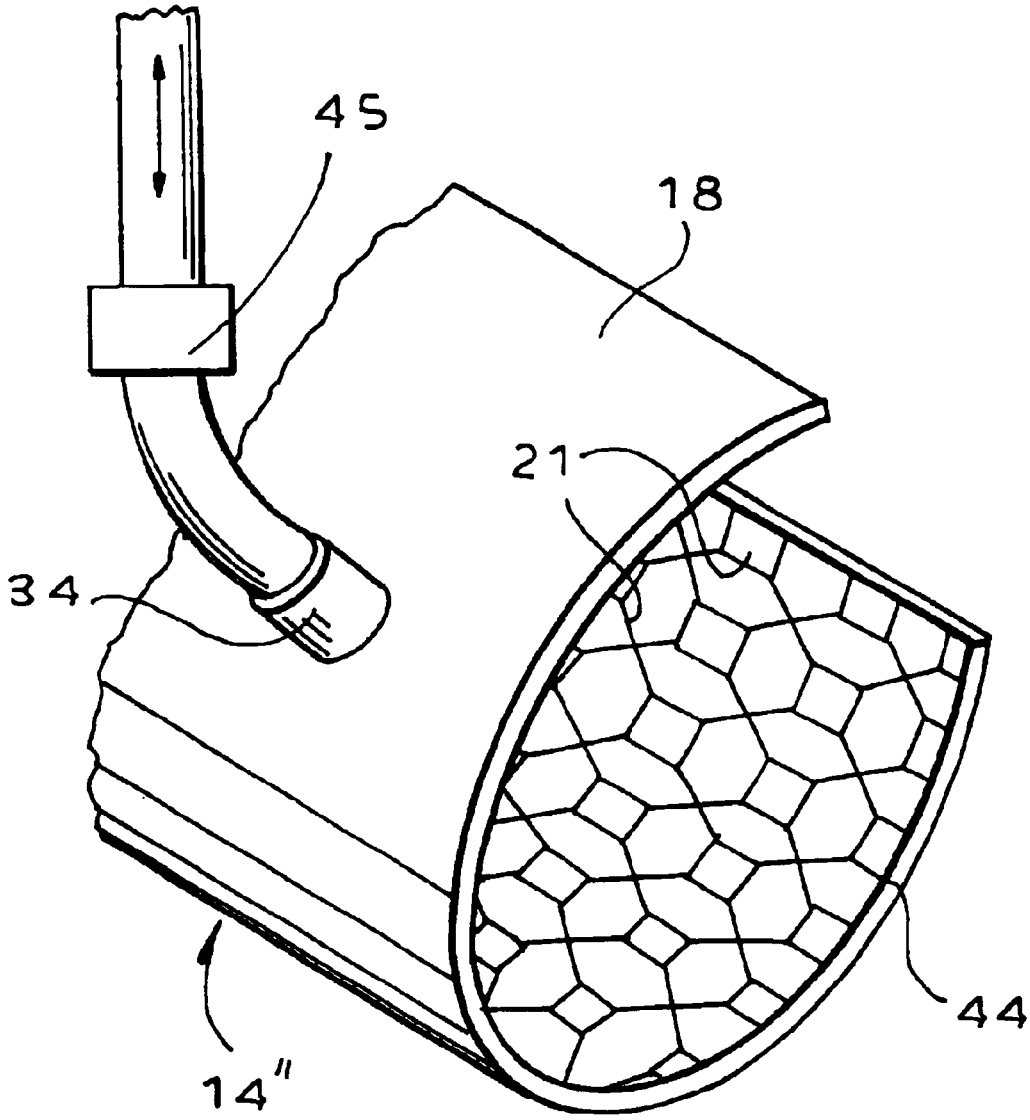
FIG. 14 is an isometric view of a fifth preferred embodiment of the present invention.

The spacer elements maintain the separation between the interior and exterior walls to insure free air flow throughout shell 14. These elements can take a variety of configurations, such as spaced, radially extending rectangular elements 20, as illustrated in FIGS. 1–6, honeycomb elements 21, as illustrated in FIGS. 7, 8 and 14, or spacer 25 with a bellows-like configuration, as illustrated in FIGS. 9 and 11. The spacer elements are preferably composed of the same material as wall 16. Whichever form of spacer elements is utilized, a plurality of air passageways 26 are provided through each spacer element such that the air will flow freely between the sections of chamber 22, defined by the spacer elements.

The spacer elements are preferably formed integrally with interior shell wall 16, as illustrated in FIGS. 1–6. However, in a situation where the elements are interconnected so they can stand alone as a unit, such as the honeycomb elements 21 of FIGS. 7, 8 and 14 or in the bellows-like spacer 25 of FIGS. 9 and 11, the spacer may be supplied in rolls or sheets, separately from wall 16. In that case, the spacer is trimmed appropriately and mounted over inner layer 10, if wall 16 is not present, as shown in FIG. 14 or over wall 16, after wall 16 is situated around inner layer 10. As illustrated in FIG. 11, hook and loop tape strips 27 can be used at the corners of spacer 25 in conjunction with hook and loop strips 31 on walls 16 and 18 to provide a more slip resistant fit relative to the shell walls.

The housing is completed by the installation of a relatively flexible (in bending) but non-extensible exterior wall 18, which is secured to hold the structure together tightly around the limb and sealed to provide an air tight seal, isolating the interior of the housing. Wall 18 is made of flexible material, such as plastic, reinforced plastic, fabric or the like or elastomer sheets of sufficient thickness (stiffening) to withstand the pressure changes which will be applied to the housing, minimally deform during this process and to maintain the tight fit of the housing.

Wall 18 may be supplied on rolls or in sheets and is trimmed as required. It is then placed tightly over the interior wall and spacer assembly. The edges of wall 18 are overlapped and sealed to each other to form an air tight joint using hook and loop tape or by strips of adhesive sealing tape 19 or the like. The ends of the housing are likewise sealed to the limb by adhesive sealing tape 99 or other conventional means such as clamps or belts to prevent air from escaping.

Belts or straps 28 are also used to encircle the housing at various locations along its length and are tightened to maintain the secure fit of the housing. This causes the shell to become sufficiently rigid to withstand the rapid pressure changes. Belts or straps 28 are flexible in bending but relatively inextensible and may have buckles or other fastening means 29. Hook and loop tape can be used to secure the exterior wall or to make the inner wall slip resistant.

Figure 6:
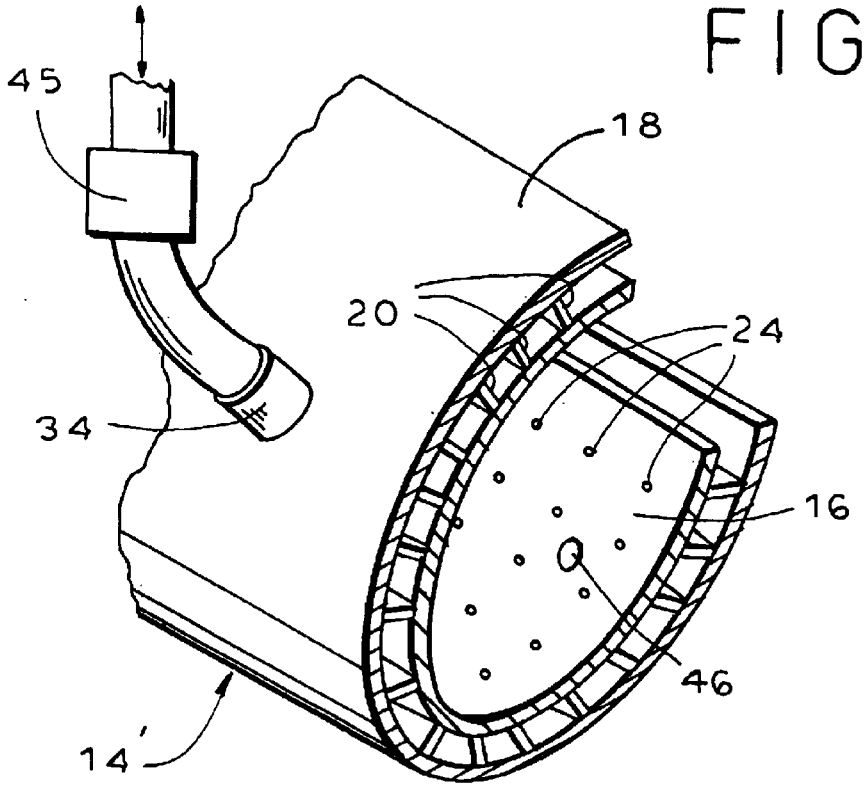
FIG. 6 is an isometric view of a typical section of the shell of a second preferred embodiment of the present invention.

FIG. 6 illustrates a preferred embodiment of shell 14' in which the walls 16, 18 and spacer elements 20 are all integral, such that the shell 14' is a unitary structure. In this case, the shell 14' is initially deformable and may be provided on a roll or in sheet form. Shell 14' is then cut and trimmed appropriately, wrapped around the inner layer 10, sealed and secured.

Instead of providing the shell in rolls or sheets, it is possible to provide it in sections, each several inches wide, which are individually fitted around the inner layer surrounding the limb, adjacent to each other, in side by side relation, transverse to the axis of the limb. The sections are sealed together with sealing tape and secured with belts or straps 28, as necessary. The transverse sectional embodiment is illustrated in FIG. 10, which shows a shell formed of a plurality of contiguous shell sections 14*a*, 14*b*, 14*c* and 14*d* extending transverse to the axis of the limb. Using transverse shell sections in this manner permits even greater conformity to the shape of the limb and greater flexibility with regard to the length of the housing.

Figure 13:
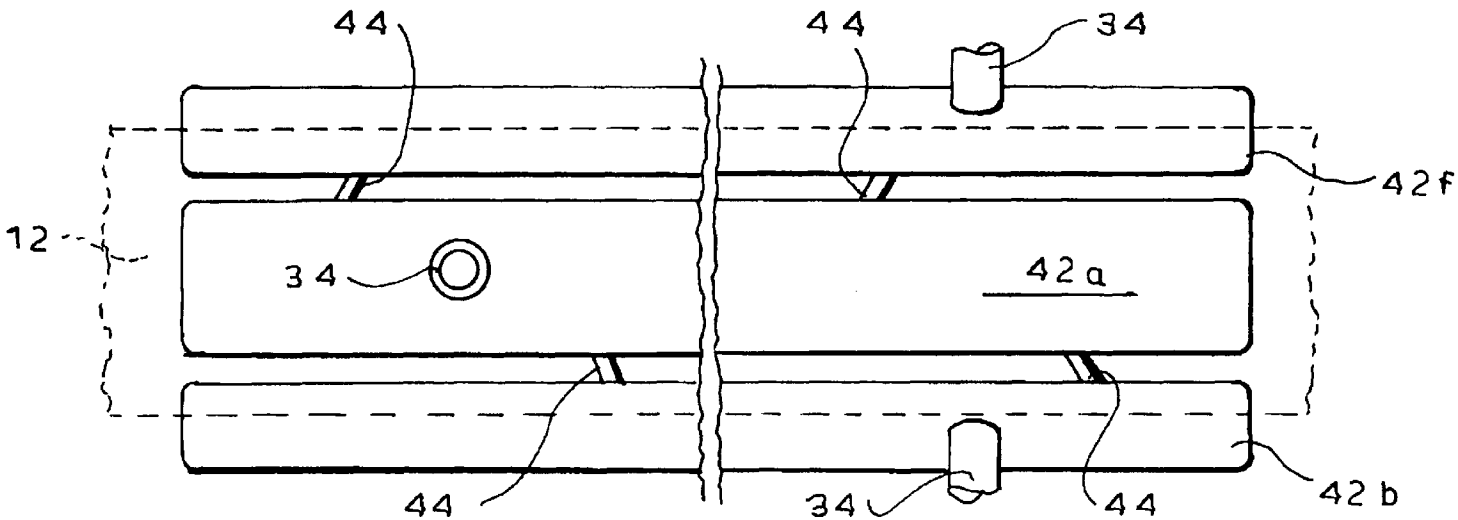
FIG. 13 is an elevational view of the embodiment illustrated in FIG. 11.
Figure 12:
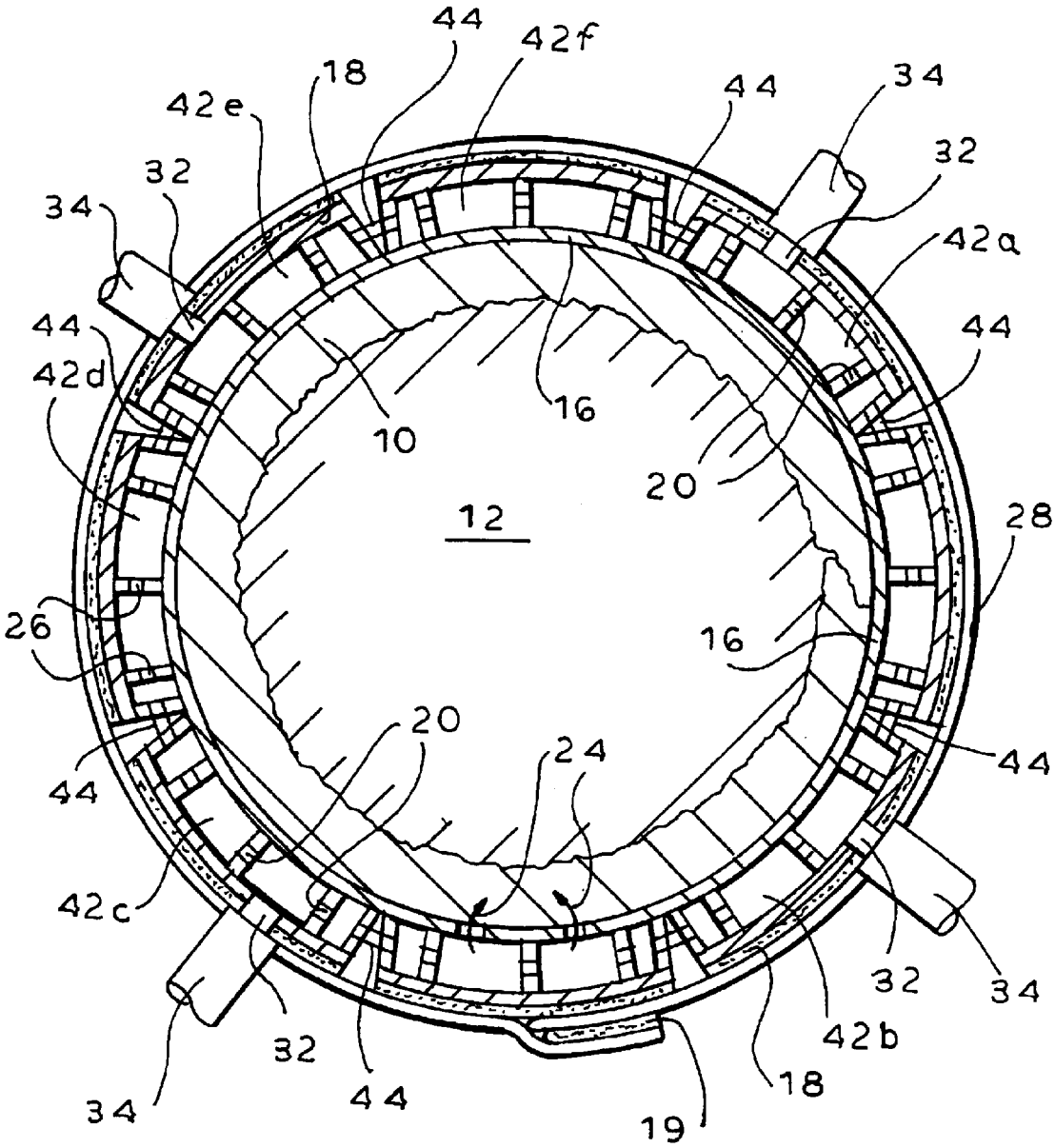
FIG. 12 is a cross-sectional view of a seventh preferred embodiment of the present invention.

FIGS. 12 and 13 illustrate another preferred embodiment of the present invention in which the shell is divided into longitudinal sections 42*a*, 42*b*, 42*c* . . . adapted to extend parallel to the axis of the limb 12. These sections are connected together by hinges, preferably "living hinges." As in the other embodiments, sections 42*a*, 42*b*, 42*c* . . . surround inner layer 10 of porous material which could be fabric, sponge-like or the similar materials. The inner wall 16 of each section 42 is provided with multiple air openings 24. Each section 42 includes spacer elements 20 such that internal air chambers 22 are formed. Sections 42*a*, 42*b*, 42*c* . . . are connected together by flexible tubes 44 to permit air to pass freely therebetween. A plurality of connectors 34 are provided for connection to the air source.

The sections 42*a*, 42*b*, 42*c* . . . are surrounded by belts or strips 28 to secure the housing around the limb and to render it relatively rigid. These securing means can be made of hook and loop tape or other inextensible fabric.

FIG. 14 illustrates the preferred embodiment of the shell 14" in which the inner layer 10 and the interior wall 16 are absent. Spacer means 21 are shown as honeycomb in configuration.

Air is moved into and out of internal shell chamber 22 thorough one or more ports 32 in exterior wall 18. Each port 32 is provided with a connector 34 of conventional design to permit a hose or conduit to be connected between the port and the air source.

As indicated above, the fluid used is preferably air, but could be other gases or even liquids, such as water. However, since the fluid must move in and out of the housing rapidly, a low viscosity fluid is preferred.

For some applications, compressed air from tanks 50 can be used for the application of positive relative pressure and the internal air chamber can simply be vented to relieve the pressure. However, if negative relative pressure is required, vacuum creating equipment 52 is needed. Tanks 50 and vacuum equipment 52 can be connected to the housing by suitable valving 54.

FIG. 2 illustrates, in schematic form, a pump 36 which could be used to supply to and remove air from the housing. Pump 36 includes air tight bellows 37 which contracts to push air into the internal air flow chamber of the shell to pressurize the housing and expands to draw air out of the chamber to create a relative vacuum within the shell interior.

The expansion and contraction of the bellows is controlled by an off-center cam 38 which rotates on a shaft 40. Shaft 40 is driven by an electric motor 101, through a commonly used speed reduction and controlled clutch system to operate the pump in accordance with the signals sensed by an electrocardiograph or other heart function monitoring device 100 which may be coupled to a patient 102. Pump 36 is spring loaded toward the expanded condition of bellows 37 such that negative relative pressure (vacuum) is provided during each cycle. The appropriate valving (not shown) is provided between the pump and the housing ports, so as to feed air to the ports.

A microprocessor based computer device or system 104 may be coupled to the electrocardiograpgh or heart function monitoring device 100 and may receive information signals therefrom indicative of the patient's heart function or operation, such as information signals pertaining to cardiac diastole and cardiac systole. The computer system 104 may produce a control signal in accordance with the received cardiac diastole and cardiac systole information signals and supply the same to the motor 101 and/or to the value 54 and/or other such device to control the flow of air into and/or from the housing in accordance with the cardiac diastole and cardiac systole of the patient 102.

In FIG. 2, for the sake of simplicity, the mechanism of affecting expansion and contraction of the bellows is shown to be by an off-center cam driven by an electric motor. However, any mechanism of producing linear motion by electric power, e.g., a lead screw mechanism, or a linear electric motor with appropriate motion transmission and controller, may also be used. In addition, since the positive relative pressure and relative vacuum generation periods are only a portion of the full cycle of operation of the system, the electric motor driving the pump can be used to store mechanical energy in the form of potential energy in the pump spring and in motor mounted flywheels. This would greatly reduce the size of the electric motor required to operate the pump.

The pump 36 shown in FIG. 2 is uniquely suited for use with the housing of the present invention because together they form a closed system in which the same air is moved back and forth between the pump and the housing as the bellows 37 expands and contracts. This permits the use of a smaller capacity pump and greater control over the temperature of the air within the housing. The smaller capacity pump permits the apparatus to be portable such that it can more easily be brought to a patient in an emergency situation. Of course, the capacity of the pump is determined by the size of the housing it is being used with.

Preferably, a heater element 45 and a temperature sensor 46 are employed to maintain the temperature of the air which is introduced into the housing at an elevated level, as shown in FIG. 6. Heat promotes vascular dilation and hence increased blood flow, resulting in an increase in the effectiveness of the device.

Other possible air sources could include a "double acting" pump, eliminating the need for the internal spring. Such a pump has the advantage of more accurate control over pressure levels and profiles. Piston pumps and rotary pumps could be used as well.

More than one air source could also be used. Multiple pumps, operating synchronously, may provide more uniform pressure application. The pumps could be set up to permit the system to operate at a higher number of cycles per second than a single pump. If used alternately, one pump or set of pumps could be compressing the air as the other forces the compressed air into the housing and visa versa.

Whatever type of air supply equipment is utilized, it is important to keep the volume of the shell interior and of the connection conduits to a minimum and the fit of the housing as close as possible to the contour of the limb. This reduces the volume of the space to be pressurized, the amount of air and vacuum required and hence capacity of the air supply pump.

It will now be apparent that the present invention relates to an external counterpulsation cardiac assist device including a sealed housing adapted to be assembled for custom fit and be mounted around the limb so as to provide alternating positive and negative relative pressure in synchronization with heart function.

The housing includes an air permeable fabric-like inner layer surrounded by a relatively rigid but initially deformable shell. The shell includes an internal air flow distribution system defined between an initially deformable interior wall which can be made to snugly conform to the limb and a flexible exterior wall, separated from the inner wall by spacer elements so as to define an air flow chamber to facilitate the movement of air to and from the housing interior. The shell is sealed around the limb by adhesive sealing tape 99 or the like and secured tightly to the limb by belts, straps or the like.

While only a limited number of preferred embodiments of the present invention have been disclosed for purposes of illustration, it should be obvious that many variations and modifications could be made thereto. It is intended to cover all of these variations and modifications which fall within the scope of the present invention, as defined by the following claims:

We claim:

1. An external counterpulsation cardiac assist device for varying pressure on a body segment of a patient comprising means for receiving air, means for controlling the flow of air in accordance with cardiac systole and cardiac diastolic of said patient, and a housing adapted to surround the body segment, said housing comprising a shell formed of interior and exterior walls, said interior shell wall containing air transfer openings permitting air flow into the space interior to the interior shell wall, spacer means comprising a plurality of elements sufficiently rigid to maintain said exterior shell wall in spaced relation with said interior shell, said spacer elements comprising air transfer openings so as to permit air flow between said walls, and means for connecting said air receiving means to said space between said shell and the body segment to vary the pressure within said space in synchronization with heart function.

2. The device of claim 1 wherein said interior shell wall comprises a plurality of openings.

3. The device of claim 1 wherein the air receiving means includes a port in said exterior shell wall.

4. An external counterpulsation cardiac assist device for use on a body segment of a patient comprising means for receiving air, means for controlling the flow of air in accordance with cardiac systole and cardiac diastolic of said patient, and a housing, said housing comprising a shell having an exterior wall and adapted to surround the body segment; and spacer means interposed between said exterior shell wall and the body segment, said spacer means comprising a plurality of elements comprising air transfer openings permitting air flow within a space between said exterior shell wall and the body segment, and means for operably connecting said air receiving means to said space between said shell and the body segment, wherein the ends of said shell are substantially sealed to the body segment such that said space forms a closed space between said shell and the body segment and further comprising an inner layer situated within said closed space between said shell and the body segment, and wherein said shell further comprises an interior wall and wherein said spacer means is situated between said interior and exterior shell walls.

5. The device of claim 4 wherein said interior shell wall comprises a plurality of openings.

6. The device of claim 5 wherein said interior shell wall and said spacer means are connected to form an assembly.

7. The device of claim 4 wherein said interior shell wall and said spacer means are connected to form an assembly.

8. The device of claim 7 wherein said exterior shell wall is situated over said assembly.

9. The device of claim 4 wherein said interior shell wall and said spacer means are integral.

10. The device of claim 4 wherein said interior shell wall is composed of rubber.

11. The device of claim 4 wherein said interior shell wall is composed of plastic.

12. The device of claim 4 wherein said interior shell wall is composed of movably connected sections.

13. The device of claim 12 wherein said sections extend longitudinally relative to the body segment.

14. The device of claim 4 wherein said interior shell wall comprises first and second relatively moveable sections.

15. The device of claim 4 wherein said interior and exterior walls and spacer components are integral.

16. An external counterpulsation cardiac assist device for use on a body segment comprising means for moving air in synchronization with heart function, and a housing, said housing comprising a tubular shell having an exterior wall adapted to surround the body segment; means for sealing the ends of said shell to the body segment so as to form a closed space between said shell and the body segment; and spacer means comprising a plurality of elements comprising air transfer openings permitting air flow within said closed space between said exterior shell wall and the body segment, and means for operably connecting said air moving means to said closed space between said shell and the body segment, and further comprising an inner layer situated within said closed space between said shell and the body segment and wherein said shell further comprises an interior wall and wherein said spacer means is situated between said interior and exterior shell walls and wherein said interior shell wall comprises a plurality of openings and wherein said interior shell wall and said spacer means are connected to form an assembly, and further comprising means for securing said exterior shell wall over said assembly.

17. An external counterpulsation cardiac assist device for use on a body segment comprising means for moving air in synchronization with heart function, and a housing, said housing comprising a tubular shell having an exterior wall adapted to surround the body segment; means for sealing the ends of said shell to the body segment so as to form a closed space between said shell and the body segment; and spacer means comprising a plurality of elements comprising air transfer openings permitting air flow within said closed space between said exterior shell wall and the body segment, and means for operably connecting said air moving means to said closed space between said shell and the body segment, and further comprising an inner layer situated within said closed space between said shell and the body segment, wherein said shell further comprises an interior wall and wherein said spacer means is situated between said interior and exterior shell walls and wherein said interior shell wall comprises first and second relatively moveable sections and wherein said sections are articulately connected.

* * * * *